United States Patent [19]

Del Bon

[11] Patent Number: 4,541,550

[45] Date of Patent: Sep. 17, 1985

[54] SELF-CLOSING TILTING VALVE

[76] Inventor: Luigi Del Bon, P.O. Box 2, 4663 Aarburg, Switzerland

[21] Appl. No.: 496,463

[22] Filed: May 20, 1983

Related U.S. Application Data

[63] Continuation-in-part of Ser. No. 284,221, Jul. 17, 1981, Pat. No. 4,389,004.

[30] Foreign Application Priority Data

Aug. 5, 1980 [CH] Switzerland ..... 5911/80

[51] Int. Cl.[4] ..... B65D 83/14

[52] U.S. Cl. ..... 222/402.22; 222/402.24

[58] Field of Search ..... 222/402.1, 402.2, 402.12, 222/402.21–402.23, 402.24; 137/614.11, 614.21; 251/354, 349

[56] References Cited

U.S. PATENT DOCUMENTS

| | | | |
|---|---|---|---|
| 2,662,669 | 12/1953 | Schmidt | 222/402.21 |
| 2,831,620 | 4/1958 | Schlicksupp | 222/517 |
| 2,892,574 | 6/1959 | Noe | 222/402.23 |
| 3,406,944 | 10/1968 | Barker | 222/402.24 X |
| 3,450,316 | 6/1969 | Barker | 222/402.22 |
| 3,759,427 | 9/1973 | Stanley et al. | 222/402.23 |
| 3,920,165 | 11/1975 | Schultz | 222/402.23 |
| 4,008,834 | 2/1977 | Towns | 222/402.23 |

*Primary Examiner*—Charles A. Marmor

*Attorney, Agent, or Firm*—Heinrich W. Herzfeld

[57] ABSTRACT

A self-closing tilting valve sealingly insertable in a lid for a container fillable with product under excess pressure and provided with a valve mounting, comprises a mandrel having a base part and a tip part, and an enveloping nozzle surrounding the mandrel and having an axial product passage receiving the mandrel therein, a head part with an outlet opening for the axial passageway, a foot part having a bottom opening for the axial passageway, and an intermediate portion extending axially between the head part and the foot part, and being substantially rigid. The mandrel top part bears a conically tapered sidewall of axially outwardly increasing diameter, and the head part of the nozzle has an outer end wall about the outlet opening correspondingly tapered to sealingly contact the top part sidewall in closed position. The intermediate portion of the nozzle between the head part and the foot part must be substantially rigid. The mandrel projects downwardly out of the foot part of the nozzle and has a base part thereof extending radially outwardly beneath the underside of the nozzle foot part. Distancing noses are provided at the lower end of the conically tapered sidewalls, which distancing noses cause a gap to be formed between these sidewalls when the mandrel is drawn downwardly axially into the axial passage during opening of the valve by tilting.

2 Claims, 3 Drawing Figures

SELF-CLOSING TILTING VALVE

RELATION TO EARLIER APPLICATION

This patent application is a continuation-in-part of my pending application Ser. No. 284,221 filed July 17, 1981 now U.S. Pat. No. 4,389,004, issued June 21, 1983.

BACKGROUND OF THE INVENTION

This invention relates to a self-closing tilting valve sealingly insertable in a lid for a container fillable with product under excess pressure and provided with a valve mounting, which valve comprises an essentially rigid mandrel member having a base part and a tip part, an enveloping nozzle member surrounding said mandrel member and having an axial product passage surrounded by an inner wall and receiving said mandrel member therein, a head part with an outlet opening for said axial passageway, a foot part having a bottom opening for said axial passageway, and an intermediate portion extending axially between said head part and said foot part, the top part of said mandrel member bearing a conically tapered sidewall of axially outwardly increasing diameter, and the head part of said enveloping member having an outer end wall about said outlet opening which outer end wall is correspondingly tapered to sealingly contact said top part sidewall in closed position.

A valve of this kind has been described in U.S. Pat. No. 2,831,620 to T. F. Schlicksupp. However, this kind of valve is not suitable for use with pressurized product-filled containers, in particular, when the internal excess pressure in the container reaches the usual values of, for instance, 3 to 5 bar. Such excess pressures would cause an expansion and/or lateral displacement of the bellow-type central zone provided in the enveloping member of Schlicksupp's valve and thus cause it to open unintentionally.

Valves of the Schlicksupp-type are, therefore, only used for liquids such as toilet water, skin lotions, perfumes and also for creams which are present in the container under no or much less excess pressure.

Another tilting valve of somewhat similar construction has been described in U.S. Pat. No. 3,920,165 to Robert S. Schultz. This valve would indeed be suitable for containers having contents under higher internal pressure. However, in this valve which contains, beside a mandrel member, an internal enveloping member and an external cap member, the tip part of the mandrel member does not remain in contact with the inner wall of the head part of the cap member when the valve is opened. Rather, a spacing apart occurs between both parts, while in the case of the tilting valve according to the invention as well as in the case of Schlicksupp's valve, these two parts should remain in contact with one another in the closed as well as in the opened position. A spacing apart between the two tiltably supported members of the Schultz valve jeopardizes a resealing of the valve after each opening stage, even when the dimensioning of the cap member and the internal enveloping member with respect to each other is very exact, because of the variable support means of the two members. For, the cap member must find support simultaneously on the container lid wall and against a shoulder provided in the sidewall of the enveloping member, which latter must in turn provide support for the mandrel member.

Other valves of the general kind having at least some features similar to those of the initially defined self-closing tilting valve are described in the British Pat. No. 928,841 to Michel, and the U.S. Pat. Nos. 3,406,944 to Barker, 3,759,427 to Stanley et al, and 4,008,834 to Towns.

Differences of structure and function which distinguish these known valves from the self-closing tilting valve of the instant invention will be discussed in detail further below.

OBJECTS AND SUMMARY OF THE INVENTION

In view of the foregoing, it is a main object of the invention to provide a self-closing tilting valve which affords a satisfactory double sealing effect, i.e. a sealing at two places in the valve, and an unobjectionable opening and closing of the valve while requiring at the same time a minimum of valve parts, and the simplest possible manner of assembling the valve.

This object and others which will become apparent in the following description, are attained in a tilting valve of the initially described type which possesses the following characterizing features in accordance with the present invention, namely that (a) the intermediate portion of the nozzle member between the head part and the foot part thereof, is substantially rigid, (b) the mandrel member projecting downwardly out of said foot part of the nozzle member and having a base part thereof extending radially outwardly beneath the underside of the nozzle member foot part away from the central longitudinal axis of the mandrel member, (c) the nozzle member foot part bearing on its underside about the bottom opening therein an obturating surface, and the base part bearing on its upper side turned toward the underside of the nozzle member foot part, a correspondingly located counter face, whereby, when the valve is in closed position internal pressure prevailing under said valve will urge said obturating surface and counter face into sealing engagement; and, according to a most important feature of the invention, on which fully satisfactory functioning without excessive demands on accurate dimensioning depends, (d) distancing means provided at the lower end of one of the conically tapered walls, which distancing means cause a gap to be formed between the conically tapered sidewalls when the mandrel member is drawn downwardly axially into the axial passage during opening of the valve.

Preferably, the upper rim portion of the base part is supported, during opening of the valve, against the underside of the foot part on the side of applied tilting pressure (windward side), while being moved downwardly out of contact with said foot part underside on the opposite (leeward) side.

The nozzle member preferably has an outer sidewall surface above the foot portion thereof and an annular shoulder facing axially downward and being adapted for abutting against the container lid mounting, which shoulder is located in the outer sidewall of the enveloping member.

As mentioned above, the lateral wall of the tip part of the mandrel member must have a conical outwardly broadening tapering, i.e. with the cone apex toward the container interior, and the head part of the enveloping member must have a corresponding conical bevel about the outlet opening which bevel is flared toward the outside, in the inner wall of the enveloping member surrounding the outlet opening. Moreover, in the inner peripheral zone of the beveled wall portion of one of the two members there must be provided the said distancing means comprising at least one projection which extends radially toward the corresponding zone of the other member, thus ensuring formation of a gap between the two beveled wall portions when the valve is being opened.

In this embodiment of the tilting valve according to the invention, the base part of the mandrel member extends downwardly, i.e. toward the container interior, beyond the underside of the foot part of the enveloping member and has a broadened head having an annular shoulder facing toward the said foot part underside and being in sealing contact with the latter when the valve is in closed position.

The above-described features and embodiments of the tilting valve according to the invention allow a particularly uncomplicated and, therefore, cost-saving manufacture of the valve parts, with easy removal of molds and cores in the case of injection molding, and an easy assembly of the valve.

The construction of this type of valve is simplified particularly by the fact that the functions which must be carried out by a plurality of elements in the hitherto known valves, are now fulfilled by a minimum number of elements, namely two, in the valve according to the invention, as well as in the valve described by Stanley et al.

However, in the Stanley et al valve, functioning of the top obturating means is unsafe during closed position, and also when opening the valve (see hereinafter).

In the valve according to the invention, the satisfactory obturation of product passages in the closed valve is guaranteed by elements exerting positive sealing pressure. At the same time, the double sealing effect namely between the tip part and the head part, on the one hand, and the base part and the foot part, on the other hand, of the mandrel element and the enveloping element, is effected in a most simple manner requiring no high-precision dimensioning of the elements and nevertheless satisfying all requirements for a satisfactory sealing even when the product in the container is at a pressure of from 3 to 5 bar above ambient pressure, or even higher. Tests have shown safe sealing up to 20 bar, while operation of such valves is usually requiring about 8 bars.

The tilting valve according to the invention also permits a very simple filling of product into the container by way of the valve after mounting of the same in the container, without requiring the tilting of the mandrel member and or the enveloping member. This is not possible in the case of the known valves described hereinbefore.

BRIEF DESCRIPTION OF THE DRAWINGS

Further details of the invention will become apparent from the following description thereof in connection with the accompanying drawings in which.

DETAILED DESCRIPTION OF THE EMBODIMENT SHOWN IN THE DRAWING

Figure 2:
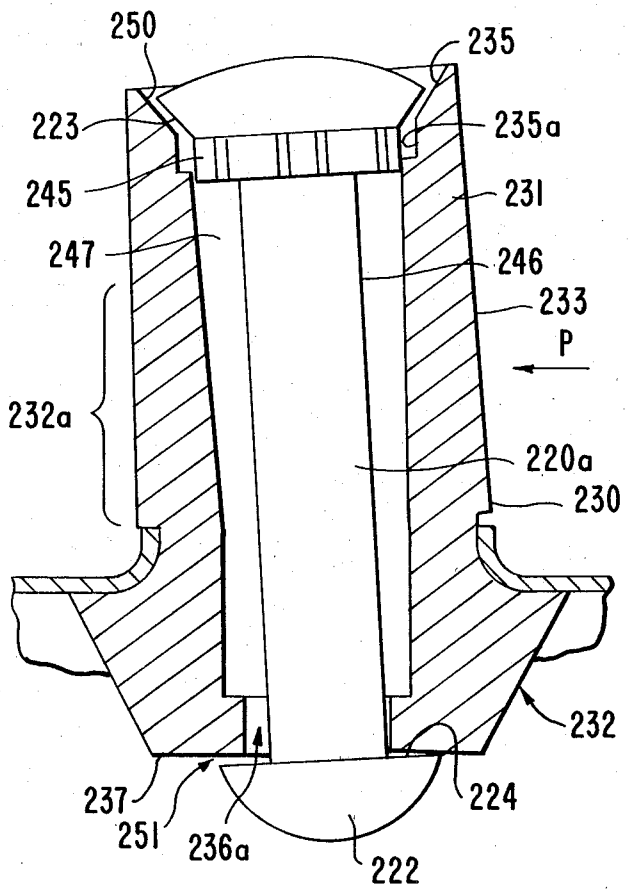
FIG. 2 shows the same section as FIG. 1, but with the parts in open position.
Figure 1:
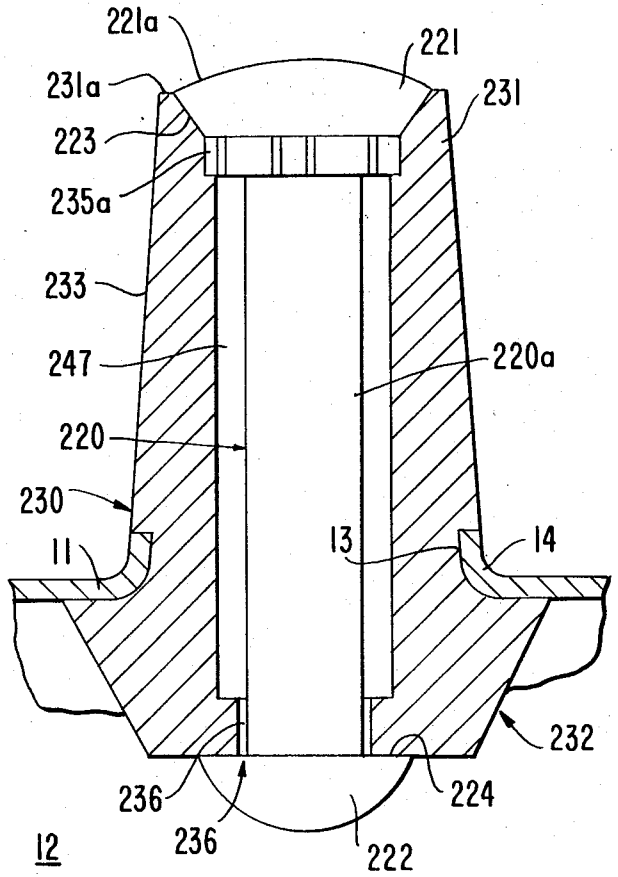
FIG. 1 is an axial sectional view of a preferred embodiment of the tilting valve according to the invention, with the parts in closed position.

The embodiment of the tilting valve according to the invention, as shown in FIGS. 1 and 2 is mounted in the lid 11 of a container (not shown) which holds a pasty, creamy or liquid product 12 under pressure; the valve closes an outlet orifice 13 provided in the lid 11 which orifice 13 is surrounded by a socket part 14 projecting outwardly, i.e. away from the container interior.

The valve comprises a mandrel member 220 having a tip part 221, a base part 222 and a shaft or stem part **220*a*** connecting the aforesaid two parts.

The lateral wall 223 of the tip part 221 is beveled, preferably conically, with its cross-section increasing outwardly toward a frontal end face **221*a* of the tip part 221**.

The base part 222 is of larger diameter than the stem part **220*a*, thus providing an annular shoulder 224**, the surface of which serves as one of the sealing faces of the valve.

The valve further comprises an enveloping nozzle member 230 having a head part 231 and a foot part 232 which are connected with each other by a middle wall portion **232*a* which is substantially rigid and preferably of generally frusto-conical configuration and preferably has a conically tapered external wall surface 233**.

The enveloping member has a central axis passageway or bore 247 which opens in the top end face **231*a* of the head part 231 through an outlet opening 235, while, toward the container interior, the passageway 247 opens into a chamber 236 which is preferably of cylindrical configuration and which opens out of the underside 237 through an orifice 236*a*. Thereby, the region of the underside 237 of the nozzle member about the said orifice 236*a* serves as a counter surface to the sealing surface 224 on the mandrel member base part 222**.

In the preferred embodiment of a tilting valve shown in FIGS. 1 and 2, the contact surfaces 223 and 235 constitute frusto-conical mantle faces which narrow in inward direction along the valve axis and whose cone apex is located on this axis inwardly, with the cone base located toward the outside; distancing projections 245 are provided in this embodiment about the periphery of the smaller, inwardly located frusto-cone end face. These spacing projections 245 protrude at the upper end of the cylindrical wall 246 of the mandrel member from the latter into the free space 247 between the mandrel member 220 and the nozzle member 230.

When tilting the valve, the enveloping member 230 and the mandrel member 220 are tilted with displacement of the tip or head parts 221 and 231 relative to one another. Thereby, when the projections 245 are mounted at the lower end of the mandrel member tip part 221, the conical surface 235 of the nozzle head part 231 comes into contact at its lower, preferably slightly recessed end **235*a* with one or several of the projections 245 and is thereby lifted off the opposite conical contact face 223, thus forming a gap 250**.

At the same time, a gap 251 is formed between the base part 222 of the mandrel member 220 and the underside **232*a* of the foot part 232 of the enveloping member 230. This permits product to emerge from the valve via the gap 251, the passageway 247 and the gap 250**, e.g. as a foam.

In contrast to the type of valve described and claimed in the patent application Ser. No. 284,221 (now U.S. Pat. No. 4,389,004), the novel valve described herein thus has the base part of the mandrel member projecting out of the foot part of the nozzle member, and having an enlarged base part with an annular upper face which rests in closed position sealingly against the underside of the foot part of the nozzle member. When opening the valve, the base part comes to rest with the region of the aforesaid annular upper face on the windward (pressure-ward) side against the underside of the nozzle member foot part while the opposite region of the upper base part face is moved downwardly, due to the tilting of the mandrel member, out of contact with the underside of the nozzle member foot part, so that pressurized product can pass into the preferably annular passageway between the mandrel member and the surrounding nozzle member.

In the prior art, the British Pat. No. 928,841 to MICHEL and the U.S. Pat. No. 3,920,165 to SCHULTZ, disclose valves in which the tilting opening of the base part of the mandrel member takes place in a similar manner, while the passageway in the case of the U.S. patents to SCHULTZ and U.S. Pat. No. 4,008,834 to TOWNS, is located over the greater length of the mandrel member in an annular axial recess of the latter and emerges only near the top part of the latter. In the valve according to the instant invention the product passageway must be located between the outer cylindrical surface of the mandrel member and the inner wall of the enveloping nozzle member. This greatly facilitates manufacture of the mandrel member.

Another important difference between the instant valve according to the invention and the valve described in U.S. Pat. No. 4,389,004 (Ser. No. 284,221) is found in the construction of the mandrel member top part engaging, at all times, i.e., during closing position as well as during open position, the conical sealing face of the head part of the nozzle member. In contrast to the corresponding part of the Ser. No. 284,221 valve type, the conically tapered surface in the inner nozzle member wall about the outlet opening is flared outwardly so that the smaller diameter of the frusto-conical space surrounded by the conically tapered surface extends in the zone where it merges with the preferably cylindrical passageway extending axially through the nozzle member, while the larger diameter of the frusto-conical space is at the outer, upper end of the nozzle member head part.

Figure 3:
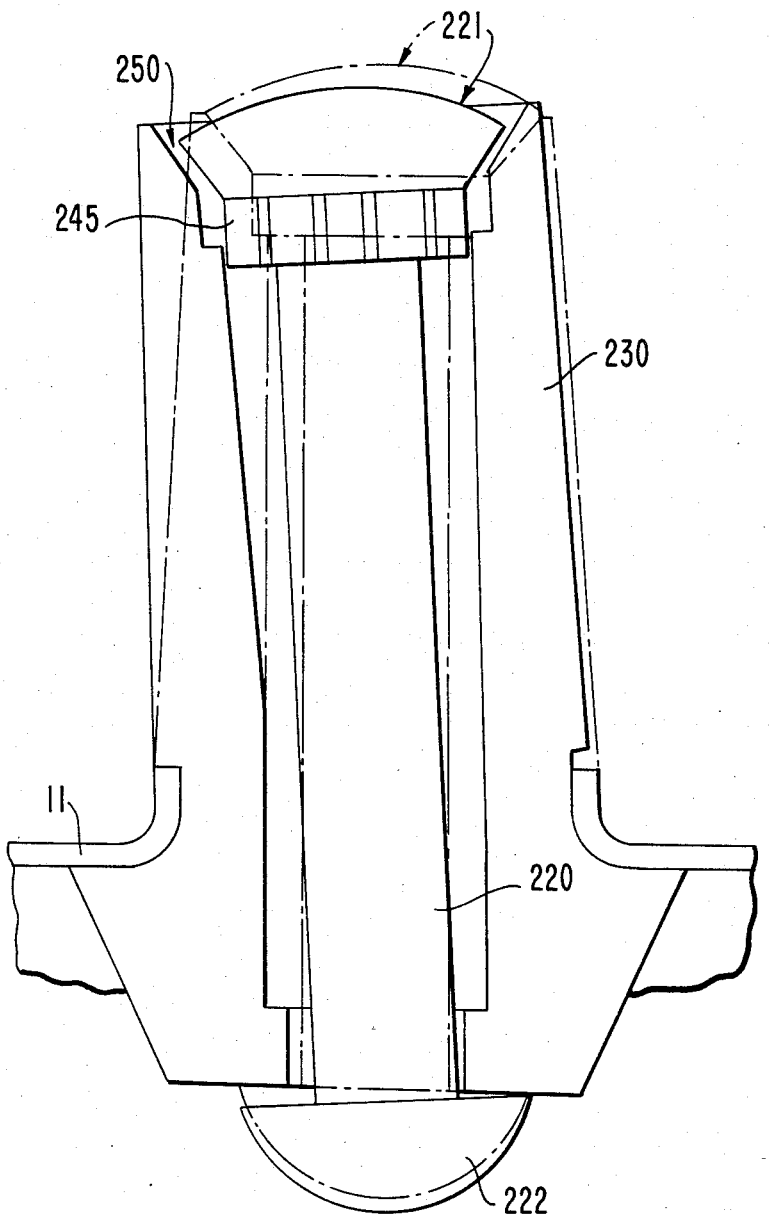
FIG. 3 shows, in one and the same axial sectional view, the two members of the embodiment of FIGS. 1 and 2 in phantom lines in the closed position, and in drawn out lines in the open position.

As shown in phantom lines in FIG. 3, the top part 221 of the mandrel in the valve according to this invention is of a corresponding frusto-conical shape with the conically tapered side wall 223 of this top part 221 resting in sealing contact with the conically tapered surface 235 of the nozzle member head part 231, when the valve is in closing position. About the zone in which the frusto-conical top part 221 merges with the preferably cylindrical intermediary stem part 220*a* of the mandrel member 220, the top part 221 bears a crown of radially outwardly and axially downwardly protruding merlon-type projections 245 and axially extending recesses or grooves 235*a* between them. This crown of projections 245 can be housed also, preferably with play, in an annular recess in the conically tapered surface 235 of the nozzle member head part 231, which recess forms a radially extending annular shoulder with the axial passageway 247 of the nozzle member 230.

As shown in FIG. 3 in drawn-out lines, upon tilting of the nozzle member 230 and mandrel member 220, the mandrel member top part 221 is drawn axially downwardly, so that the merlon-type projections 245 are moved out of their lodging recess or recesses 235*a* into the contiguous narrower passageway 247 of the nozzle member 230, thereby widening this region of the passageway 247 and, together therewith, the entire nozzle member head part 231. Thereby, the conical surfaces 223,235 of the mandrel member top part 221 and at the outlet opening of the nozzle member 230 become disengaged from one another, opening a gap 250 therebetween. Pressurized product rising in the nozzle member passageway 247 can then pass through the recesses 235*a* between the merlon-type crown projections 245 into the last mentioned gap 250 and to the outside.

While the U.S. Pat. No. 3,406,944 to BARKER and U.S. Pat. No. 3,759,427 to STANLEY et al show outwardly flared conical top portions as or at the head part of their mandrel members, the functioning of these obturating means of the prior art is entirely different.

In the U.S. patent to BARKER the entire nozzle member is moved axially downwardly, while the mandrel member of this known valve remains practically stationary. The respective movement of the two members of the BARKER valve is therefore the opposite of what occurs in the valve according to my invention.

Also, in the STANLEY et al valve the relative movement of the head part of the nozzle member and the outwardly flared end portion of the mandrel member, at least on the pressure-ward side, is opposite to that of these members in the valve of the instant invention (see FIG. 3). Moreover, neither BARKER nor STANLEY et al disclose the slightest suggestion of a crown of merlon-type projections about the lower end of the frusto-conical mandrel member top part.

More in detail, the valve according to the invention is distinguished over the disclosure of the U.S. patent to Stanley et al because:

(1) The intermediate portion 232*a* of the nozzle member is substantially rigid. In contrast thereto, the corresponding portion (at 21) of Stanley et al's nozzle member 19 is readily bendable so that the windward side of the nozzle portion is bent against the central region (at 36) of the valve stem 20 while the same intermediate nozzle portion on the leeward side is bulged away from the valve stem 20.

(2) The base part 222 of the mandrel member 220 in the valve according to the instant invention extends radially outwardly beneath the underside 237 of the nozzle member foot part 232, while in Stanley et al's valve the nozzle member base part 29 is embraced.

(3) The valve according to the invention is further most decisively distinguished from the valve of Stanley et al by the provision of the distancing means defined under (b). Without provision of such distancing means the valve according to the invention would not function properly. As the mandrel member 220 is tilted due to pressure exerted on its top part 221 on the windward side, the leeward side of the base part 222 moves away from the underside 232*a* and opens a gap 251 through which product under full internal can pressure will penetrate into the passageway 247 of the nozzle member. However, as the leeward side of the mandrel member base part 222 moves downwardly, so will the leeward side of the mandrel member top part 221, so that sealing contact between the latter part and the corresponding valve seat 235 in the head part of the nozzle member will be increased and this upper obturation means will not open. Therefore, if the teaching of the instant valve minus the distancing means were used to modify the Stanley et al valve, the latter valve would not function properly. If, for instance, by relieving pressure P on such a modified Stanley et al valve, a small gap would open during the return of both members to their closing position, the dammed-up product under pressure in the passageway would be suddenly and unexpectedly ejected through such gap in a single compact jet.

None of the remaining references, namely the U.S. patents to Schultz and Towns, has a head part of the nozzle member and top part of the mandrel member, that would even remotely suggest the configuration of these parts in the valve according to the invention.

Prior art having come to my attention from sources outside the field of the valves of application Ser. No. 284,221 and of the instant application is the U.S. Pat. No. 2,662,669 to John Schmidt.

The only feature that the Schmidt valve disclosed in that patent has in common with the valve of the instant invention is the rigid mandrel member 33 which is tiltable in a supporting sleeve 32 of substantially rigid synthetic material.

However, the lower part 35 of this mandrel is housed with snug fit in a slot valve body 16 having four slot lips 16 split by longitudinal slits 18, which valve body 16 is of highly elastically resilient polymeric material. None of the distinctive features particularly pointed out hereinbefore as characteristic of the valve according to the invention are found or suggested to an art-skilled person in the disclosure of this patent.

Through the valve according to the invention there can be discharged such products as cosmetics, pharmaceuticals, cleansing agents, or foodstuffs. As propellants there can be used all those whose use is permitted in conventional aerosol spray cans.

In order to open the valve according to the invention, for the purpose of filling product into an empty container, with the junction socket of the filling machine making a hermetic seal with the nozzle member head part 231, sufficient downward axial pressure without tilting is applied to the mandrel member tip part 221 to cause the projections 245 to penetrate in the passageway 247 below the recess or recesses 235*a*, but not so deeply that the conical tip part face 223 could obturate again the entry passage, thus produced, by sealingly engaging a lower zone of the unrecessed portion of the conical head part surface 235. The axial height of the conical tip part 221 and of the projections 245 as well as of the conical head part surface 235 can be so chosen as to essentially avoid this re-closure.

The terms "upward", "downward", "upper side", "lower side" or "underside⇄ and similar terminology refer to positions of the respective parts as shown in the accompanying drawings, while "inner," "outer", "axially inward" and "axially outward" refer to the positioning of parts of the tilting valve according to the invention with respect to the container on which the valve is to be mounted. The foot part and the base part of, respectively, the enveloping and the mandrel member are also referred to as the lower end parts of these members, while the head part and the tip part of these members are also referred to as their upper end parts.

I claim:

1. Self-closing tilting valve sealingly insertable in a lid for a container fillable with product under excess pressure and provided with a valve mounting, which valve comprises an essentially rigid mandrel member having a base part and a tip part, an enveloping nozzle member surrounding said mandrel member and having an axial product passage surrounded by an inner wall and receiving said mandrel member therein, a head part with an outlet opening for said axial passageway, a foot part having a bottom opening for said axial passageway, and an intermediate portion extending axially from said head part toward said foot part, the top part of said mandrel member bearing a conically tapered sidewall of axially outwardly increasing diameter, and the head part of said enveloping member having an outer end wall about said outlet opening which outer end wall about said outlet opening is correspondingly tapered to sealing contact with said top part sidewall in closed position, (a) said intermediate portion of said nozzle member between said head part and said foot part thereof, being substantially rigid, (b) said mandrel member projecting downwardly out of said foot part of said nozzle member and having a base part thereof extending radially outwardly beneath the underside of the nozzle member foot part away from the central longitudinal axis of said mandrel member, said base part having a circumferential rim, (c) said nozzle member foot part bearing on its underside about said bottom opening therein an obturating surface, and said base part bearing on its upper side turned toward the underside of said nozzle member foot part, a correspondingly located counter face, whereby, when said valve is in closed position internal pressure prevailing under said valve will urge said obturating surface and counter face into sealing engagement; and, upon applying a tilting pressure on one side of said intermediate portion of said nozzle member the rim of the base part of said mandrel member on the same side of applied tilting pressure remains supported on said underside of said nozzle member foot part while the rim of the base part of said mandrel member on the opposite side is moved downwardly out of contact with said underside of said nozzle member foot part, thereby opening said valve, and said rigid mandrel member is moved axially downwardly in said axial nozzle member passage, and (d) distancing means radially projecting at the lower end of one of said conically tapered walls, which distancing means widen the upper end of said nozzle member in the region at and below the lower end of said conically tapered sidewall thereof and thereby cause a gap to be formed between said conically tapered sidewalls when said mandrel member is moved downwardly axially in said axial passage during opening of said valve.

2. Tilting valve according to claim 1, wherein said nozzle member has an outer sidewall surface above said foot portion thereof and an annular shoulder facing axially downward and being adapted for abutting against said container lid mounting, said shoulder being located in said outer sidewall.

* * * * *